US011197089B2

(12) United States Patent
Meng et al.

(10) Patent No.: US 11,197,089 B2
(45) Date of Patent: Dec. 7, 2021

(54) SOUND GENERATING DEVICE

(71) Applicant: AAC Technologies Pte. Ltd., Singapore (SG)

(72) Inventors: Yiming Meng, Shenzhen (CN); Guqing Zhang, Shenzhen (CN); Wei Pang, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/996,926

(22) Filed: Aug. 19, 2020

(65) Prior Publication Data

US 2021/0112332 A1 Apr. 15, 2021

(30) Foreign Application Priority Data

Oct. 10, 2019 (CN) ..... 201910960030.X

(51) Int. Cl.
*H04R 1/28* (2006.01)
*H04R 7/12* (2006.01)
*H04R 9/02* (2006.01)

(52) U.S. Cl.
CPC ..... *H04R 1/2834* (2013.01); *H04R 7/127* (2013.01); *H04R 9/025* (2013.01)

(58) Field of Classification Search
CPC ..... H04R 1/2834; H04R 7/127; H04R 9/025
See application file for complete search history.

(56) References Cited

U.S. PATENT DOCUMENTS 9,271,070 B2 * 2/2016 Abe ..... H04R 1/086
2020/0351592 A1 * 11/2020 Zhao ..... H04R 9/025

FOREIGN PATENT DOCUMENTS

CN 205647943 U * 10/2016

* cited by examiner

*Primary Examiner* — Sunita Joshi
(74) *Attorney, Agent, or Firm* — W&G Law Group

(57) ABSTRACT

The present disclosure provides a sound generating device, which includes a frame, a vibration system, and a magnetic circuit system. The vibration system includes a membrane, a dome, and an air-permeable isolating piece. The membrane is fixed to the frame and configured to define an inner sound generating cavity together with the frame and the magnetic circuit system. The vibrating membrane includes a vibrating part, a suspension, and a fixing part, the vibrating part defining a first through hole communicated with the inner sound generating cavity. The dome is attached to a side of the vibrating part, and the dome defines a second through hole communicating with the first through hole. The air-permeable isolating piece is attached to a side of the dome, and a side of the air-permeable isolating piece is sunken to form a leakage groove communicating with the second through hole.

13 Claims, 4 Drawing Sheets

A-A

A-A

SOUND GENERATING DEVICE

FIELD OF THE PRESENT DISCLOSURE

The present disclosure relates to an acoustoelectric field, and more particularly to a sound generating device of a portable electronic product.

DESCRIPTION OF RELATED ART

With the advent of mobile internet era, there are more and more smart mobile devices. Among the smart mobile devices, mobile phones are undoubtedly the most common and portable mobile terminal devices. Sound generating devices for playing sound have been widely used in the smart mobile devices, such as mobile phones.

A sound generating device in a related art includes a frame, a vibration system fixed on the frame, and a magnetic circuit system for driving the vibration system to vibrate and generate sound. The vibration system includes a membrane fixed on the frame and a voice coil for driving the membrane to vibrate, and the frame, the vibration system, and the membrane cooperatively define an inner sound generating cavity. The magnetic circuit system defines a pressure relief port for communicating the inner sound generating cavity and outside, and the pressure relief port is configured for balancing an air pressure between an inside of the sound generating device and the outside.

However, in the related art, external matters are prone to block the pressure relief port due to a small size of the pressure relief port, or external liquid may enter into the inner sound generating cavity of the sound generating device through the pressure relief port, thereby reducing the reliability of vibrating and generating sound of the sound generating device, and resulting in a poor acoustic performance.

Therefore, it is necessary to provide a new sound generating device to solve the above technical problems.

SUMMARY

An objective of the present disclosure is to provide a sound generating device with good waterproof performance, high reliability, and excellent acoustic performance.

In order to achieve the above objective, the present disclosure provides a sound generating device, which includes a frame, a vibration system and a magnetic circuit system having a magnetic gap respectively fixed on two opposite sides of the frame, the magnetic circuit system being configured to drive the vibration system to vibrate and generate sound. The vibration system includes:

a membrane, fixed to the frame and configured to define an inner sound generating cavity together with the frame and the magnetic circuit system, the membrane including a vibrating part, a suspension extending bently from a periphery of the vibrating part, and a fixing part extending bently from a side of the suspension away from the vibrating part, the fixing part being fixed on the frame, the vibrating part defining a first through hole passing through thereof, and the first through hole communicating with the inner sound generating cavity;

a dome, attached onto a side of the vibrating part away from the magnetic circuit system, the dome defining a second through hole passing through the dome and communicating with the first through hole; and an air-permeable isolating piece, attached onto a side of the dome away from the vibrating part and completely covering the second through hole, and a side of the air-permeable isolating piece closing to the dome recessed to form a leakage groove communicating with the second through hole.

In some embodiments, an orthographic projection of the second through hole onto the air-permeable isolating piece along a vibration direction of the membrane is completely fall within a range of the leakage groove.

In some embodiments, the second through hole directly face the leakage groove.

In some embodiments, an orthographic projection of the second through hole onto the membrane along a vibration direction of the vibrating membrane is completely fall within a range of the first through hole.

In some embodiments, the first through hole is located at a geometric center of the vibrating part, the second through hole is located at a geometric center of the dome, and the first through hole directly face the second through hole.

In some embodiments, the air-permeable isolating piece is made of an air-permeable film.

In some embodiments, an adhesive seal is disposed between the air-permeable isolating piece and the dome.

In some embodiments, the sound generating device further includes a cover plate fixed on a side of the frame away from the magnetic circuit system and configured to press the fixing part on the frame, the cover plate defines a sound emitting port passing through the cover plate, the cover plate and the vibrating membrane cooperatively form a front sound generating cavity, the dome and the air-permeable isolating piece are positioned in the front sound generating cavity, and the front sound generating cavity is configured to communicate with outside through the sound emitting port.

In some embodiments, an orthographic projection of the dome onto the cover plate along a vibration direction of the vibrating membrane is completely fall into the sound emitting port.

In some embodiments, the magnetic circuit system includes a yoke fixed on a side of the frame away from the vibrating membrane, the yoke and the frame cooperatively defines a leakage channel, the leakage channel communicates the inner sound generating cavity with outside. The sound generating device further includes damping parts respectively fixed to the magnetic yoke and the frame, and the damping parts completely cover the leakage channel.

Compared with the related art, in the sound generating device of the present disclosure, the vibrating part defines a first through hole passing through the vibrating part, the dome defines a second through hole passing through the vibrating part and communicating with the first through hole, the second through hole is configured to serve as a pressure relief structure between the inner sound generating cavity and outside. The air-permeable isolating piece is attached to the dome and configured to completely cover the second through hole, and the air-permeable isolating piece is sunken to form a leakage groove communicating with the second through hole. So that the inner sound generating cavity communicates with the outside through the leakage groove after sequentially passing through the first through hole and the second through hole. Through the arrangement of the air-permeable isolating piece, external matters are prevented from blocking the second through hole, and external liquid is also effectively prevented from entering the inner sound generating cavity. Therefore, the sound generating device has a good waterproof performance, the reliability of vibrating and generating sound of the sound generating device is ensured, and the acoustic performance of the sound generating device is effectively improved.

BRIEF DESCRIPTION OF THE DRAWINGS

In order to more clearly explain the technical solutions in the embodiments of the present invention, the drawings required in the description of the embodiments will be briefly introduced below. Obviously, the drawings in the following description are only some embodiments of the present disclosure. For those of ordinary skill in the art, without paying any creative work, other drawings can also be obtained based on these drawings, among them.

DETAILED DESCRIPTION OF THE EXEMPLARY EMBODIMENT

The technical solutions in the embodiments of the present disclosure will be described clearly and completely in conjunction with the drawings in the embodiments of the present disclosure. Obviously, the described embodiments are only parts of the embodiments of the present disclosure, but not all of the embodiments. Based on the embodiments of the present disclosure, all other embodiments obtained by those of ordinary skill in the art without creative work fall within the protection scope of the present disclosure.

Figure 1:
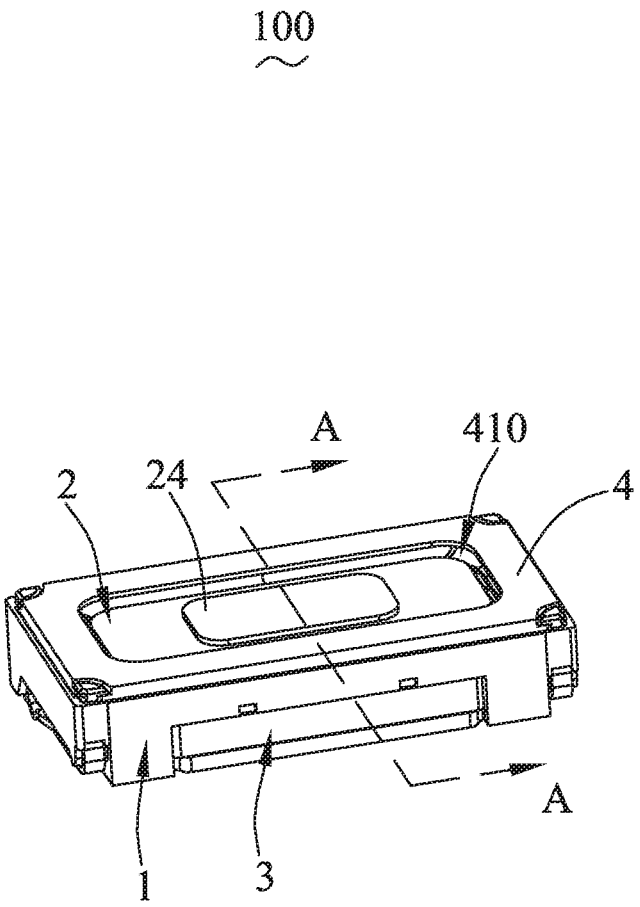
FIG. 1 is a perspective view of a sound generating device of the present disclosure.
Figure 2:
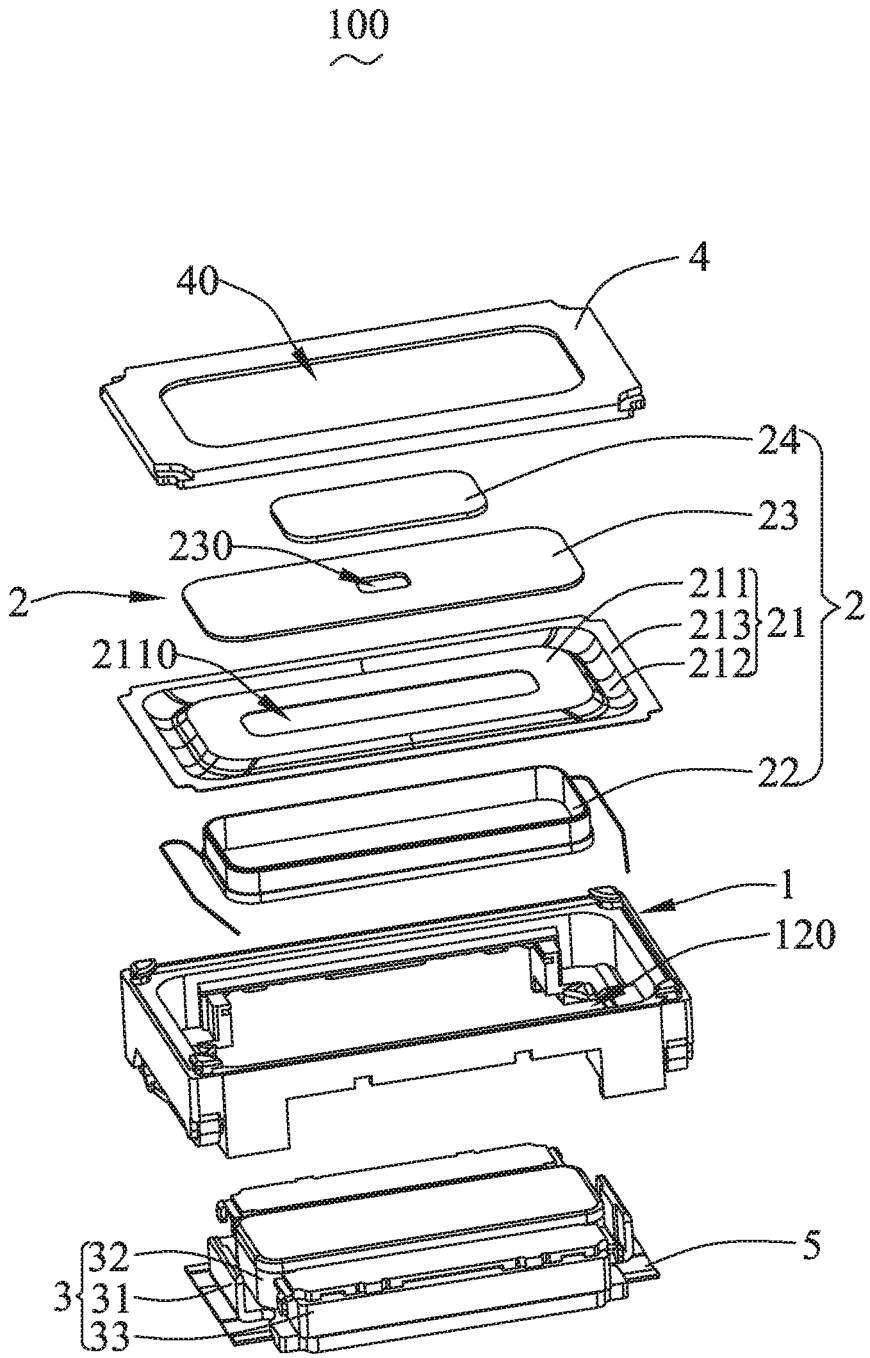
FIG. 2 is a partial exploded view of the sound generating device of the present disclosure.
Figure 3:
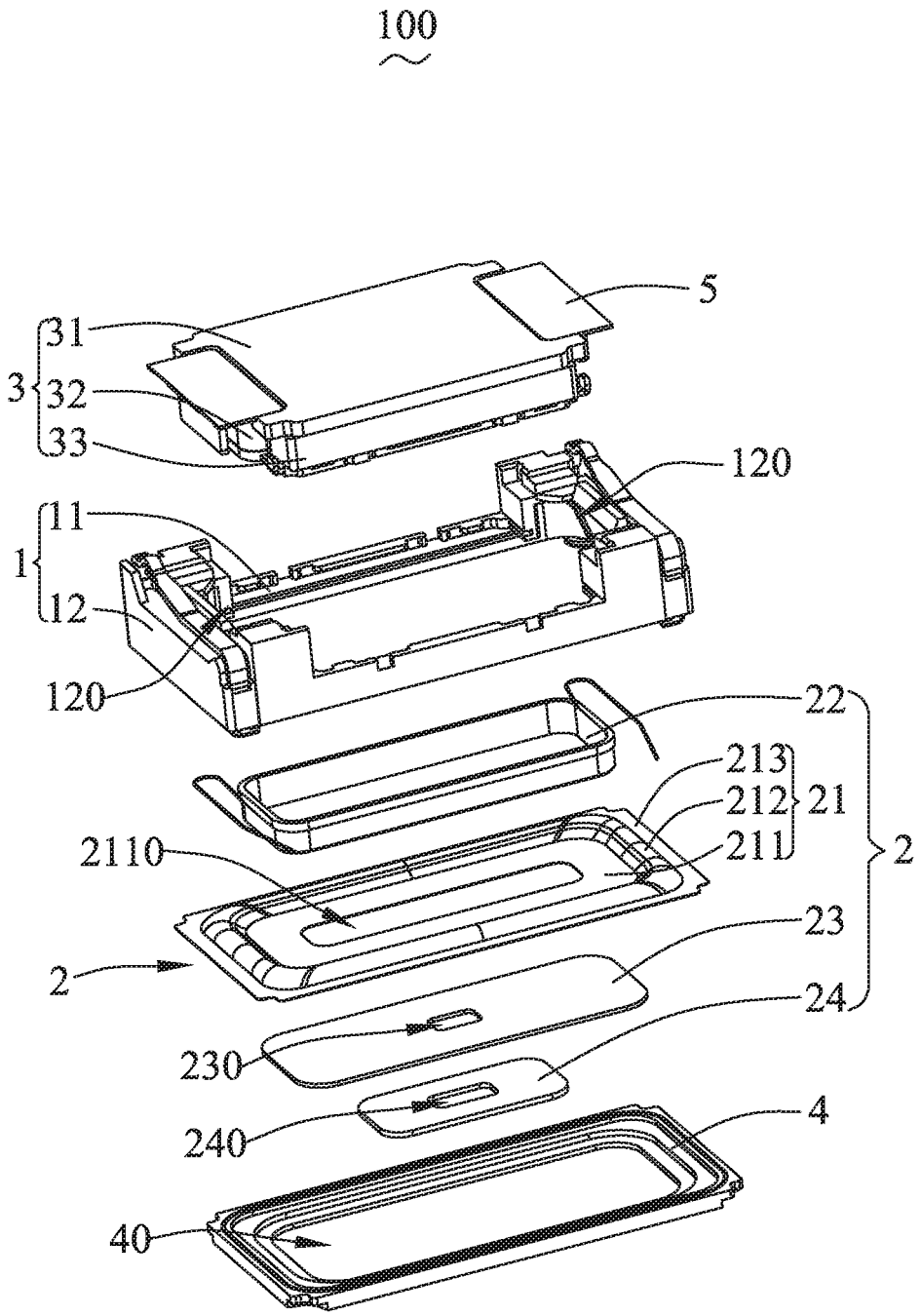
FIG. 3 is another partial exploded view of the sound generating device of the present disclosure shown from another view.
Figure 4:
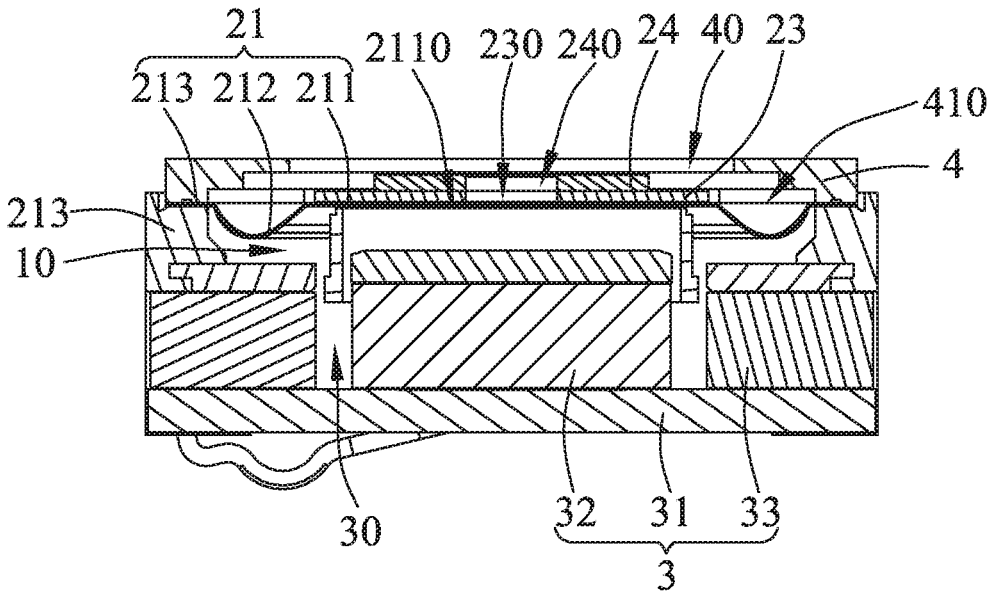
FIG. 4 is a cross sectional view taken along a line A-A in FIG. 1.

Referring to FIGS. 1 through 4, the present disclosure provides a sound generating device 100, which includes a frame 1, a vibration system 1 and a magnetic circuit system 3 respectively fixed on two opposite sides of the frame 1, the magnetic circuit system 3 has a magnetic gap 30, and the magnetic circuit system 3 is configured to drive the vibration system 2 to vibrate and generate sound.

The frame 1 includes an annular frame body 11, and two fixing walls 12 respectively protruding from two opposite sides of the frame body 11.

The vibration system 2 includes a membrane 21, a voice coil 22, a dome 23, and an air-permeable isolating piece 24.

The membrane 21 is fixed to the frame 1, and configured to form an inner sound generating cavity 10 together with the frame 1 and the magnetic circuit system 3.

The membrane 21 includes a vibrating part 211, a suspension 212 extending bently from a periphery of the vibrating part 211, and a fixing part 213 extending bently from a side of the suspension 212 away from the vibrating part 211. The fixing part 213 is fixed to the frame 1. The vibrating part 211 defines a first through hole 2110 passing through the vibrating part 211, and the first through hole 2110 is communicated with the inner sound generating cavity 10. Specifically, the fixing walls 12 are configured to extend along a vibration direction of the vibrating membrane 21, and the fixing part 213 is fixed to the frame body 1.

The voice coil 22 is inserted into the magnetic gap 30 and fixedly connected with the vibrating part 211 to drive the vibrating part 211 to vibrate and generate sound.

The dome 23 is attached to a side of the vibrating part 211 away from the magnetic circuit system 3, and the dome 23 defines a second through hole 230 passing through the dome 23 and communicating with the first through hole 2110.

The air-permeable isolating piece 24 is attached to a side of the dome 23 away from the vibrating part 211 and completely cover the second through hole 230. A side of the air-permeable isolating piece 24 closing to the dome 23 is recessed to form a leakage groove 240 communicating with the second through hole 230.

With the configuration of above structure, the second through hole 230 is configured to serve as a pressure relief structure between the inner sound generating cavity 10 and the outside, and the second through hole 230 communicates with the outside through the leakage groove 240, for balancing the air pressure between the inner sound generating cavity 10 and the outside and effectively ensuring the acoustic performance of the inner sound generating cavity 10. When the air-permeable isolating piece 24 completely covers the second through hole 230, external matters are prevented from blocking the second through hole 230 and bad influence to the air pressure balance adjustment causing by the external matters is avoided, and external liquid is also effectively prevented from entering the inner sound generating cavity 10 and a damage to the inner sound generating device 100 causing by the external liquid is also avoided. That is, while ensuring the good waterproof performance, the reliability of vibrating and generating sound of the sound generating device 100 is also guaranteed and its acoustic performance is effectively improved.

In some embodiments, an orthographic projection of the second through hole 230 onto the air-permeable isolating piece 24 along the vibration direction of the vibrating membrane 21 is completely fall within a range of the leakage groove 240, and the leakage groove 240 is served as a leakage channel for communicating the second through hole 230 with the outside and providing a buffer space for an air pressure balance adjustment between the second through hole 230 and the outside. When a size of the leakage groove 240 is larger than a size of the second through hole 230, the leakage groove 240 may provide the second through hole 230 with a larger buffer space for leakage, thereby effectively avoiding the restriction of the small second through hole 230 to the air pressure balance adjustment. As such the size of the second through hole 230 is not limited, and the reliability of vibrating and generating sound of the sound generating device 100 is higher and the acoustic performance of the sound generating device 100 is further improved.

Furthermore, in order to make the air pressure balance adjustment between the inner sound generating cavity 10 and the outside more reliable, the second through hole 230 is arranged to directly face to the leakage groove 240, so that the air flow can smoothly flow into the leakage groove 240 from the second through hole 230 during a leakage process, which further improves the reliability of the air pressure balance adjustment, thereby the acoustic performance of the sound generating device 100 is optimized.

It is worth mentioning that the air-permeable isolating piece 23 is made of an air-permeable membrane, and the air-permeable mesh structure provides a condition for realizing the air pressure balance adjustment between the inner sound generating cavity 10 and the outside, meanwhile the air-permeable mesh structure also provides a condition for isolating the outside foreign matters and liquid from the inner sound generating cavity 10.

In some embodiments, an adhesive seal is arranged between the air-permeable isolating piece 24 and the dome 23, and the adhesive seal further optimizes the waterproof performance of the sound generating device 100. So that the waterproof reliability of the sound generating device 100 is higher, and the problem that the air-permeable isolating piece 24 may fall off when use is avoided, thereby the assembly reliability is improved.

It should be noted that in order to ensure the air flow smoothly flowing between the first through hole 2110 and the second through hole 230, as a preferred embodiment, an orthographic projection of the second through hole 230 onto the vibrating membrane 21 along the vibration direction of the vibrating membrane 21 is configured to completely fall within a range of the first through hole 2110. In addition, positions of the first through hole 2110 and the second through hole 230 are not limited, the first through hole 2110 is located at a geometric center of the vibrating part 211, the second through hole 230 is located at a geometric center position of the dome 23, and the first through hole 2110 is arranged to directly face to the second through hole 230, which effectively improves the reliability of the air pressure balance adjustment.

The magnetic circuit system 3 is fixed on a side of the frame 1 away from the vibrating membrane 21.

Specifically, the magnetic circuit system 3 includes a yoke 31 fixedly connected to a side of the fixing wall 12 away from the membrane 21, a main magnet 32 fixed to the yoke 31, and two auxiliary magnet 33 respectively fixed to two opposite sides of the yoke 31, the two auxiliary magnet 33 forming the magnetic gap 30 together with the main magnet 32. The yoke 31, the frame 1, and the vibrating membrane 21 cooperatively define the inner sound generating cavity 10, and the main magnet 32 and the two auxiliary magnet 33 are received in the inner sound generating cavity 10.

Further, the yoke 31 and the frame 1 jointly form a leakage channel 310. More specifically, the leakage channel 120 is formed between the yoke 31 and the fixing wall 12. The leakage channel 120 is configured to communicate the inner sound generating cavity 10 with the outside. The sound generating device 100 further includes damping members 5 fixed to the yoke 31 and the frame 1, respectively. The damping members 5 are configured to completely cover the leakage channel 120. The leakage passage 120 is served as another pressure relief structure of the inner sound generating cavity 10, so that the pressure relief area between the inner sound generating cavity 10 and the outside is increased, the air pressure balance adjustment of the inner sound generating cavity 10 is facilitated, and the acoustic performance of the sound generating device 100 is further improved. In addition, the arrangement of the damping members 5 can effectively prevent foreign matters from entering into the inner sound generating cavity 10 and effectively ensure the sound reliability of the sound generating device 100.

The sound generating device 100 further includes a cover plate 4 fixed on a side of the frame 1 away from the magnetic circuit system 3 and configured to press the fixing part 213 on the frame 1. The arrangement of the cover plate 4 ensures the reliability of the assembly of the membrane 21. The cover plate 4 defines a sound emitting port 40 passing through the cover plate 4. The cover plate 4 and the membrane 21 cooperatively form a front sound generating cavity 410. The dome 23 and the air-permeable isolating piece 24 are located in the front sound generating cavity 410. The front sound generating cavity 410 is communicated with the outside through the sound emitting port 40, that is, the airflow in the sound emitting inner cavity 10 passes through the air-permeable isolating piece 24 and enters into the front sound generating cavity 410, then communicates with the outside through the sound emitting port 40.

In some embodiments, an orthographic projection of the dome 23 onto the cover plate 4 along the vibration direction of the membrane 21 is configured to completely fall into the sound emitting port 40. This kind of arrangement provides sufficient sound emitting area for the vibration system 2, thereby effectively avoiding a sound distortion caused by too small sound emitting area, protecting a sound emitting effect of the vibration system 2, and optimizing the acoustic performance of the sound generating device 100.

Compared with the related art, in the sound generating device of the present disclosure, the vibrating part defines a first through hole passing through the vibrating part, the dome defines a second through hole passing through the vibrating part and communicating with the first through hole, the second through hole is configured to serve as a pressure relief structure between the inner sound generating cavity and outside. The air-permeable isolating piece is attached to the dome and configured to completely cover the second through hole, and the air-permeable isolating piece is sunken to form a leakage groove communicating with the second through hole. So that the inner sound generating cavity is communicated with the outside through the leakage groove after sequentially passing through the first through hole and the second through hole. Through the arrangement of the air-permeable isolating piece, external matters are prevented from blocking the second through hole, and external liquid is also effectively prevented from entering the inner sound generating cavity. Therefore, the sound generating device has a good waterproof performance, the reliability of vibrating and generating sound of the sound generating device is ensured, and the acoustic performance of the sound generating device is effectively improved.

The description above is only some embodiments of the present disclosure. It should be pointed out here that for those of ordinary skill in the art, improvements can be made without departing from the inventive concept of the present disclosure, which are all within the scope of the present disclosure.

What is claimed is:

1. A sound generating device, comprising a frame, a vibration system, and a magnetic circuit system having a magnetic gap, the vibration system and the magnetic circuit system respectively fixed on two opposite sides of the frame, the magnetic circuit system being configured to drive the vibration system to vibrate and generate sound; wherein the vibration system comprises:

a membrane, fixed to the frame and configured to define an inner sound generating cavity together with the frame and the magnetic circuit system, the membrane comprising a vibrating part, a suspension extending bently from a periphery of the vibrating part, and a fixing part extending bently from a side of the suspension away from the vibrating part, the fixing part being fixed on the frame, the vibrating part defining a first through hole penetrating through the vibrating part, and the first through hole communicating with the inner sound generating cavity;

a dome, attached to a side of the vibrating part away from the magnetic circuit system, the dome defining a second through hole penetrating through the dome and communicating with the first through hole; and an air-permeable isolating piece, attached to a side of the dome away from the vibrating part and completely covering the second through hole, and a side of the air-permeable isolating piece closing to the dome recessed to form a leakage groove communicating with the second through hole;

the sound generating device further comprising a cover plate fixed on a side of the frame away from the magnetic circuit system and configured to press the fixing part on the frame, the cover plate defining a sound emitting port passing through the cover plate, the cover plate and the vibrating membrane cooperatively forming a front sound generating cavity, the dome and the air-permeable isolating piece being positioned in the front sound generating cavity, and the front sound generating cavity being configured to communicate with outside through the sound emitting port.

2. The sound generating device according to claim 1, wherein an orthographic projection of the second through hole onto the air-permeable isolating piece along a vibration direction of the vibrating membrane is configured to completely fall within a range of the leakage groove.

3. The sound generating device according to claim 2, wherein the second through hole directly face the leakage groove.

4. The sound generating device according to claim 1, wherein an orthographic projection of the second through hole onto the vibrating membrane along a vibration direction of the vibrating membrane is completely fall within a range of the first through hole.

5. The sound generating device according to claim 4, wherein the first through hole is located at a geometric center of the vibrating part, the second through hole is located at a geometric center of the dome, and the first through hole directly face the second through hole.

6. The sound generating device according to claim 1, wherein the air-permeable isolating piece is made of an air-permeable membrane.

7. The sound generating device according to claim 1, wherein an adhesive seal is arranged between the air-permeable isolating piece and the dome.

8. The sound generating device according to claim 1, wherein an orthographic projection of the dome onto the cover plate along a vibration direction of the vibrating membrane is completely fall into the sound emitting port.

9. The sound generating device according to claim 1, wherein the magnetic circuit system comprises a yoke fixed on a side of the frame away from the membrane, the yoke and the frame cooperatively defining a leakage channel, the leakage channel communicating the inner sound generating cavity with outside; the sound generating device further comprises damping parts respectively fixed to the yoke and the frame, the damping parts completely covering the leakage channel.

10. The sound generating device according to claim 2, wherein an orthographic projection of the second through hole onto the vibrating membrane along a vibration direction of the membrane is completely fall within a range of the first through hole.

11. The sound generating device according to claim 10, wherein the first through hole is disposed at a geometric center of the vibrating part, the second through hole is disposed at a geometric center of the dome, and the first through hole directly faces the second through hole.

12. The sound generating device according to claim 3, wherein an orthographic projection of the second through hole onto the membrane along a vibration direction of the vibrating membrane is completely fall within a range of the first through hole.

13. The sound generating device according to claim 12, wherein the first through hole is disposed at a geometric center of the vibrating part, the second through hole is disposed at a geometric center of the dome, and the first through hole directly faces the second through hole.

* * * * *